United States Patent [19]

Hernandez et al.

[11] Patent Number: 4,459,784

[45] Date of Patent: Jul. 17, 1984

[54] COMPUTER LENS BLOCK AND METHOD OF FORGING

[76] Inventors: William D. Hernandez; Adolph Behnke, both of P.O. Box 728, Tarpon Springs, Fla. 33589

[21] Appl. No.: 960,225

[22] Filed: Nov. 13, 1978

[51] Int. Cl.[3] ..... B24B 41/06

[52] U.S. Cl. ..... 51/216 LP; 419/28

[58] Field of Search ..... 51/216 R, 216 LP, 217 LP; 75/214; 148/126; 419/28

[56] References Cited

U.S. PATENT DOCUMENTS

| | | | |
|---|---|---|---|
| 2,224,168 | 12/1940 | Tillyer | 51/216 LP |
| 2,686,391 | 8/1954 | Porter | 51/216 LP X |
| 3,140,568 | 7/1964 | Beasley | 51/216 LP |
| 3,192,676 | 7/1965 | Buckminster | 51/216 LP |
| 3,448,549 | 6/1969 | McCall | 51/216 LP |
| 4,002,471 | 1/1979 | Sarnes | 419/28 |

*Primary Examiner*—Harold D. Whitehead

[57] ABSTRACT

A lens block used to secure an opthalmic lens during its formation by conventional forming equipment wherein the lens block comprises an integrally formed single piece structure of hardened metal material having centering means including a plurality of linearally aligned apertures each having a substantially conical configuration formed directly in the surface of the lens block oppositely disposed to the surface which is interconnected to the lens itself. The lens block is formed from a powdered metal material comprised of hard metal alloys which is sintered and heat treated to attain a desired condition of particle hardness in the upper range of the Rockwell C Scale.

10 Claims, 6 Drawing Figures

COMPUTER LENS BLOCK AND METHOD OF FORGING

FIELD OF THE INVENTION

This invention related to a one-piece, integrally formed lens block of the type commonly used with conventional machining, grinding and processing equipment in the formation of opthalmic lenses wherein the lens is secured to a surface of the block through various adhesive compositions, cements, low temperature alloys and/or thermal plastic compounds commonly used for purposes of fastening lens blanks to the lens block during the formation of the lens blank.

DESCRIPTION OF THE PRIOR ART

In the formation of a lens blank and more particularly in the formation of a predetermined surface of the lens blank, conventional procedures used in the optical lens industry include the attachment of the lens blank to a lens block and in turn the positioning of the attached lens blank and the lens block and in turn the positioning of the attached lens blank and the lens block to a grinding or a polishing machine. Conventional lens blocks presently in use are generally formed from a soft iron or like material body which have incorporated therein a plurality, preferably three hardened inserts. These inserts are substantially conically configured and are so disposed so as to provide similarly conically shaped apertures in an exposed surface of the block to which is attached the interconnecting portion of the forming machine used to produce and form the lens blank. There conical inserts are generally pressed into the body of the lens block and are so designed to allow replacement of the various inserts after they have become worn through continued use. In order to allow this replacement of the various inserts, the body, conventionally, has been formed of a relative soft metal or like material so as to allow press fitting of the inserts. Because of the relative softness of such metal or like material the block body generally has an operable life usable only for a limited number of replacement sets of inserts.

The user of the lens block is therefore faced with the obvious costs associated with labor and material of replacing such inserts. Such procedure is accordingly both costly and time consuming especially in view of the fact that the lens block body itself will eventually have to be replaced. Such a procedure is especially burdensome when considering the large quantity of block bodies which are used by the larger optical lens manufacturers.

U.S. patents having issued which are representative and which disclose conventional lens block structures include the following: U.S. Pat. No. 2,859,568 by Dantic; U.S. Pat. No. 3,140,568 by Beasley; U.S. Pat. NO. 3,192,676 by Buckminster. As shown by an examination of the prior art patents, the lens blocks utilized and disclosed therein are generally formed from a multiple piece construction rather than from an integral one-piece lens block which, based on the problems existing in the industry, would be far more desirable.

More specifically, it is obvious from the above that there is a need in the lens producing industry for a lens block device which is integrally formed of one piece from a hardened metal alloy, yet which is specifically manufactured by a process which allows the production of a lens block having certain other desirable characteristics. Such a preferable lens block should have a surface area allowing ready adhesion to an adhesive composition used in securing the lens blank to the lens block body. In addition, the preferred lens block should be made of a hard metal alloy, which would provide a long operable life and which could be produced in an efficient and low cost manner. Such a production process available in producing such lens blocks could be a sintering process wherein the material used to form the lens block would be a powdered or particulate metal which would be sintered and otherwise heat treated to provide a degree of particle hardness preferably in the upper range on a Rockwell C Scale of hardness as well recognized in the industry. The hardness of material of the lens block body would obviously prevent the insertion of alignment inserts and, accordingly, these inserts, used to attach the lens block to forming, grinding or polishing equipment, as conventionally utilized in the industry, could be integrally formed in the block body itself during its forging and otherwise forming utilizing the sintering process.

Accordingly, the cost and time required for the replacement of the various alignment inserts would be eliminated and the resulting hard metal lens block could be used over an extended life period and then totally disposed of rather than being rebuilt. The extended life period would make disposal of the block economical in that that block per se would be able to be used for a much longer period than the conventional soft metal lens blocks which incorporate the use of hard metal alignment device inserts.

Accordingly, in a preferred lens block structure the hardness of the material would render the block body scratch and dent resistent in normal use, thereby allowing the block body to maintain a constant diameter without burrs or other deformations which in turn would allow it to properly fit in blocking and generating machines. The hardness and the fact that the block is integrally formed would provide for nondeformation of the access hole or the alignment hole for registering in blocking and generating machines. The use of a powdered metal and a sintering and heat treating process in the formation of the block would allow it to demonstrate enhanced holding capabilities when secured to the lens blank by means of conventional adhesive compositions due to its microscopically grainy surface. The hardness and strength of the sintered and heat treated block enables it to maintain its original shape and configuration throughout its life and never becomes warped or bent. Conversely, a prior art block does become warped and bent, mostly due to the pressing and hammering it is subjected to in the process of inserting and removal of its inserts. This deformation would, of course, cause misalignment when used in processing the lens.

SUMMARY OF THE INVENTION

This invention relates to a lens block structure including a process for forming the lens block wherein the block is integrally formed into a one-piece structure of hardened metal alloy material. Formation of the block in the desired fashion is accomplished through the use of a powdered or particulate metal alloy subjected to a sintering and heat treating process so as to realize a lens block structure having a particle hardness in the higher range on the recognized Rockwell C Scale for hardness.

The alignment cavities have a substantially conventional conical shape but are integrally formed directly in the outer or exposed surface of the block body so as to permit accurate alignment and registry with the well known and conventional opthalmic processing machinery now used in the industry.

The block body comprises a first and second surface each oppositely disposed to one another wherein the first surface comprises a substantially concave configuration so as to conform to a correspondingly positioned and adhesively attached surface of the lens blank. As is well known in the lens forming industry an adhesive composition such as pitch, cement, low temperature alloys and/or thermal plastic compounds are utilized in securing the lens blank to the block body for properly positioning the lens blank on the processing machinery used in the formation of the lens blank. A further structural feature of the lens block body comprises the recessed disposition of this first concave surface into the block body thereby, at least in part, defining a protruding lip which is continuous to the periphery of the first surface as well as the correspondingly positioned edge of the outer wall of the lens block body. This edge aids in the containment of the adhesive composition used to secure the lens blank being formed to the first surface.

The first surface also has formed therein a centering means in the form of two linearally configured indentations disposed in transverse relation to one another such that their junction point defines the diametrical center of the lens block. Those linearally configured indentations also are disposed in direct alignment with the alignment cavities utilized to interconnect the block body to the processing machinery as is conventional. The provision of such linear indentations allows for easy alignment of the lens over the blocking body again in the normally accepted fashion. It should be readily observed at this point that these indentations can in fact be otherwise inscribed or integrally formed on the first surface. Such other methods of inclusion can be the formation of these linear configurations in a raised or projected configuration rather than a recessed or indented fashion as set forth above.

As made clear above, the plurality of apertures, forming the alignment means are disposed in spaced apart linearally aligned relation to one another and each has a substantially inverted conical configuration so as to matingly be engaged by the probe extending from the conventional processing machine to which the block and the attached lens blank are movably connected.

The formation of the block body from a powdered or particulate hard metal alloy such as but not limited to a Nickel alloy is accomplished by a sintering process wherein the block is forged into its desired configuration into an integral one-piece unit. The hard metal alloy used should also be substantially non-corosive so as to resist rust and like non-desirable characteristics. The block is heat treated to provide desired hardness. Such hardness, as set forth above is generally considered most desirable in a higher, preferably at 40 or above reading range of particle hardness on the Rockwell C Scale. The use of the sintering process on a powdered metal compound in the formation of the lens block also provides the block with an inherent granular surface through the formation of minute or microscopic cavities on the exterior of the lens block body. The provisions of such a granular surface on the exterior of the first surface or concave surface adds to the holding characteristics of the block since the block will more readily adhere to the adhesive or cement compound which, as set forth herein, interconnects the lens blank to the first surface of the lens block body. However, the minuteness of the cavities resulting from the utilization of the sintering process provides the lens block body with a texturally smooth finish. This allows the lens block body to be readily cleaned. It also reduces the wear and deterioration of the block body itself during the actual use.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
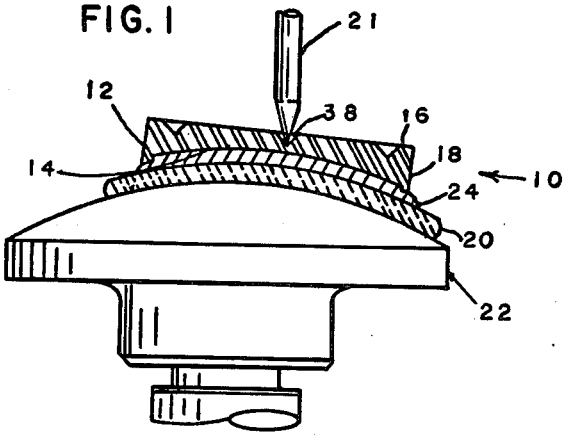
FIG. 1 is a view in section of the lens block body itself showing its mounting on a conventional opthalmic processing tool during the formation of a sperical lens.

As shown in FIG. 1 the subjection convention is directed towards a lens block generally indicated as 10 including a lens block body 12, having a first surface 14 and a second surface 16 each being oppositely disposed to one another in reference to the major mass of the block body 12. The block body is preferably formed in a substantially disc configuration defined by an outer peripheral sidewall 18 continuously disposed about the periphery of the block body 12. The first surface 14 so as to generally conform to the correspondingly connected and/or attached surface of the blank 20 being formed on the opthalmic processing tool generally indicated as 22, and commonly referred to as a lap in the industry.

As is well known in the art, the lens blank 20 is secured to the lens block body 12 by means of an adhesive compound or mixture 24 which may be any type of adhesive compound, cement, thermal plastic alloy, pitch, etc., applicable for such interconnected use. As will be explained in greater detail hereinafter the lens block body is formed from a hard metal alloy originally in a powdered metal or particulate metal state which is then sintered and heat treated to reach a predetermined degree of hardness. This process inherently provides a granular surface defined by a plurality of minute or microscopic cavities. The provision of these cavities particularly in the exterior of the first surface 14 provides superior holding capabilities in that the adhesive compound or material 24 becomes imbedded or otherwise securely attached to the cavities in the first surface 14.

Figure 3:
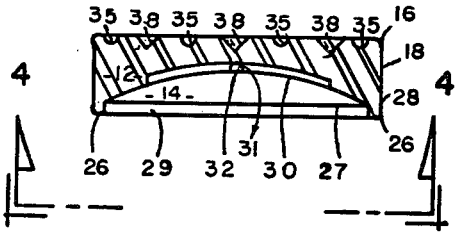
FIG. 3 is a sectional view taken along line 3—3 of FIG. 2.

Similarly, the block body is provided with an outwardly extending lip 26 contiguously disposed relative to the outer peripheral edge 27 of the first surface 14 (FIG. 3) as well as the correspondingly positioned edge 28 of the peripheral wall 18. As best shown in FIG. 3 and as represented as a cross sectional view along a diametrical access of the lens block body 10 and block body 12 the interior wall or surface 29 of the projecting lip 26 has a straight line configuration at every point along its section as shown in FIG. 3. This of course differs from numerous conventional lens block designs wherein the correspondingly positioned surface relative to the wall 29 of the lip 26 is provided with an angular projection outwardly towards the central axis of the bloc, creating a recess which is difficult to clean.

Figure 4:
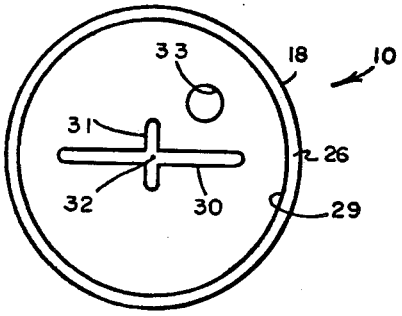
FIG. 4 is a bottom plan view taken along line 4—4 of FIG. 3 showing the first surface of the lens block body and the alignment means integrally formed therein.

With reference to FIGS. 3 and 4 alignment means is provided in the form of two linearally configured indentations 30 and 31 which are disposed in transverse intersection relation to one another so as to define a junction point 32 which in turn establishes the central axis of the block body 12. The provisions of an aperture 33 through the entire block body 10 as best shown in FIGS. 2 and 4 is utilized for the insertion of the adhesive 24 between the first surface 14 and the correspondingly positioned or connected surface of the lens blank 20.

Figure 2:
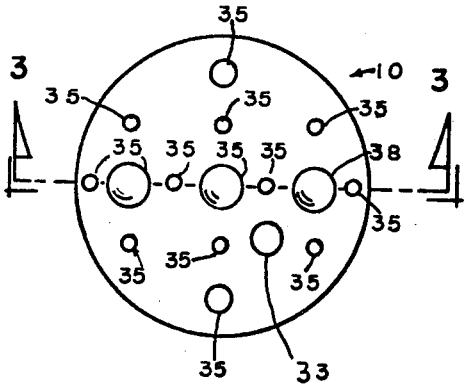
FIG. 2 is a top plan view of the second surface and the registration means integrally formed therein.

With reference to FIG. 2 a plurality of minor apertures 35 is provided so as to properly align the lens block body relative to the processing machinery (FIG. 26) and one similar to those apertures found in conventional blocking bodies.

With reference to FIGS. 1, 2, 3 and 5 centering means is also provided in the form of a plurality of inverted conically shaped recessed apertures 38 disposed in spaced apart linear and aligned relationship to one another corresponding to the central transverse axis of the block body 12 as best shown in FIG. 2. These apertures 38 are integrally formed into the second surface 16 of the block body and are provided for in a movable engagement relative to the probe 21 so as to affix it to the processing tool 22 during the formation of the lens blank 20.

Figure 6:
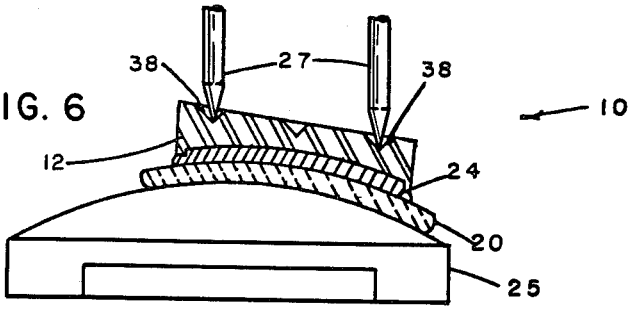
FIG. 6 is a sectional view of the lens block mounted on a conventional opthalmic processing tool during the formation of a non-spherical lens.

With reference to FIGS. 1 and 6, FIG. 1 represents the lens block 10 of the subject invention during the formation of a spherical lens 20 on a spherical lap 22. Accordingly, as well recognized in the industry, only a signle probe is utilized to engage block 10 within the centrally located centering aperture 38'. FIG. 6 however discloses the lens block 10 during the formation of a non-spherical lens 23 such as a toric or cylinder lens. Therefore lap 25 is not spherically configured and a plurality of probes 21 are mounted in centering cavaties 38' to accomplish the desired movement of block body 12 and attached lens 23' over the surface of lap 25. It can readily be seen therefore that, depending upon the desired configuration of the lens being formed, a plurality of centering cavaties 38 are required to be integrally formed in surface 16 of block body 12.

Figure 5:
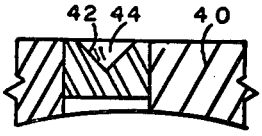
FIG. 5 ( PRIOR ART)
FIG. 5 is a sectional view in partial cut away representing the registration inserts as conventionally formed into prior art lens block body devices.

This integral formation of the centering apertures 38 differs from the conventional or prior art devices in that the block body is formed from a hardened metal alloy and thereby eliminates the utilization of hardened metal inserts in a soft metal body as generally represented by FIG. 5. More specifically, portion 40 represents a prior art lens block body wherein 42 represents a hardened metal centering insert having the recessed aperture 44 formed therein. The lens block body 40 of the prior art device is formed from a relatively soft metal material so as to allow the press fitting and the insertion of the centering insert aperture device 42 as shown and as is well known in the prior art.

Finally, an important structural feature of the present invention is the formation of the above described lens block body from a hardened metal alloy material originally in a powdered or a particulate form. The formation further includes the process of incorporating a sintering and heat treatment after the forging of the block body into the desired configuration shown in FIGS. 1 through 4. Heat treatment is accomplished to provide the desired degree of hardness dependent upon the particular hard metal alloy utilized. More specifically, predetermined times, quantities and heat temperatures are utilized to generally form the lens block body 12 to have a particle hardness generally in the higher range of from 40 or above on the recognized Rockwell C Scale. This sintering process and the formation of the lens block from a powdered metal material also provides the granular structure of the lens block body 12 as described above with regard to the detailed description of the superior holding characteristics of the first surface 14 relative to the lens blank 20 and the adhesive compound or adhesion 24.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Now that the invention has been described, what is claimed is:

1. A lens block of the type used to secure an opthalmic lens during formation of the lens surface, said lens block comprising: a forged, sintered metal one-piece block body comprising a first surface formed in one face of said block body and a second surface formed in an oppositely disposed face of said block body, said first surface having a configuration substantially corresponding to the configuration of a lens surface being formed, and said second surface comprising centering means integrally formed therein and comprising a plurality of apertures disposed in substantially aligned, linear spaced apart relation to one another, each of said apertures being defined by a substantially inverted conical configuration and being recessed into said block body from said second surface; the exterior of said lens block having minute cavities formed therein to render said surface smoothly granular, thereby affording enhanced adhesion thereto of adhesive compositions while permitting ready cleaning of said lens block surfaces.

2. A lens block as in claim 1 wherein said first surface comprises a substantially conccave configuration.

3. A lens block as in claim 2 additionally including a protruding lip providing a straight-sided peripheral wall contiguous to said first surface and extending outwardly from about the periphery thereof.

4. A lens block as in claim 1 wherein said apertures are disposed in predetermined aligned relation to a diametrical center of said first surface.

5. A lens block as in claim 4 further comprising alignment means formed in said first surface and including a first and second linear configuration disposed in transverse relation to one another so as to define a junction point, said junction point disposed to define the center of said first surface.

6. A lens block as in claim 5 wherein each of said first and second linear configurations are recessed into said first surface.

7. A lens block as in claim 1 wherein said hard metal alloy comprises a Nickel alloy.

8. A process for the production of a one-piece lens block, including the steps of: forging a powdered hard metal alloy into a lens block configuration comprised of a first surface formed in one face of said configuration and a second surface formed in an oppositely disposed face thereof, said first surface having a configuration substantially corresponding to the configuration of a lens surface to be formed, and said second surface having centering means formed therein and comprising a plurality of apertures disposed in substantially aligned, linear, spaced-apart relation to one another, each of said apertures being defined by a substantially inverted conical configuration and being recessed into said block configuration from said second surface; subjecting said forged powdered metal composition to a predetermined sintering to accomplish fusion of said powdered hard metal alloy into an integrally formed, one-piece body; and heat treating said body to produce said lens body, the exterior of said lens block having minute cavities formed therein to render the surfaces of said body smoothly granular, thereby affording enhanced adhesion thereto of adhesive compositions while permitting ready cleaning of said lens block.

9. The process of claim 8 wherein each of the aforementioned steps is performed for a predetermined period to accomplish a degree of particle hardness of at least 40 on the Rockwell C Scale.

10. The process as in claim 8 wherein said hard metal alloy comprises a Nickel alloy.

* * * * *

UNITED STATES PATENT AND TRADEMARK OFFICE

CERTIFICATE OF CORRECTION

PATENT NO. : 4,459,784

DATED : July 17, 1984

INVENTOR(S) : William D. Hernandez et al

It is certified that error appears in the above—identified patent and that said Letters Patent is hereby corrected as shown below: Title page:

In the Title: "COMPUTER LENS BLOCK AND METHOD OF FORGING" should be -- LENS BLOCK AND METHOD OF FORGING SAME --

Column 6, line 52, "surface" should be "surfaces".

Signed and Sealed this

*Fourteenth* Day of *May 1985*

[SEAL]

*Attest:*

DONALD J. QUIGG

*Attesting Officer* *Acting Commissioner of Patents and Trademarks*